United States Patent [19]

Gailiunas

[11] Patent Number: 4,641,857

[45] Date of Patent: Feb. 10, 1987

[54] SKI POLE HAND GRIP

[76] Inventor: Ernest A. Gailiunas, 10 Main St., Cotuit, Mass. 02635

[21] Appl. No.: 749,671

[22] Filed: Jun. 28, 1985

[51] Int. Cl.[4] ..... A63C 11/22

[52] U.S. Cl. ..... 280/821; 16/DIG. 12

[58] Field of Search ..... 280/821, 822, 819; 135/17, 65, 66, 72, 76; 81/489, 177.1, 177.5; 16/111 R, DIG. 12; 273/81.3, 81.4

[56] References Cited

U.S. PATENT DOCUMENTS

| | | | |
|---|---|---|---|
| 3,085,814 | 4/1963 | Scott | 280/821 |
| 3,436,090 | 4/1969 | Lange et al. | 280/821 |
| 3,582,100 | 6/1971 | Allsop | 280/821 |
| 3,880,443 | 4/1975 | Tobin | 280/821 |
| 3,933,364 | 1/1976 | With | 280/821 |
| 3,992,021 | 11/1976 | Tobin | 280/821 |
| 4,153,264 | 5/1979 | Pfister | 280/DIG. 6 |
| 4,196,742 | 4/1980 | Owen, Jr. | 280/821 |
| 4,391,456 | 7/1983 | Moor | 280/821 |
| 4,481,964 | 11/1984 | Minneman | 135/66 |
| 4,508,364 | 4/1985 | Joseph | 280/821 |

FOREIGN PATENT DOCUMENTS

| | | | |
|---|---|---|---|
| 178317 | 9/1953 | Austria | 280/819 |

*Primary Examiner*—David M. Mitchell
*Assistant Examiner*—Eric D. Culbreth
*Attorney, Agent, or Firm*—Wolf, Greenfield & Sacks

[57] ABSTRACT

A ski pole hand grip that is adapted to be attached to a ski pole shaft of a ski pole and which is positioned horizontally or near the horizontal position so as to allow the palm of the hand to be facing downwardly. The hand grip comprises a support base that is adapted to be attached to the ski pole shaft and a hand grip that is integrally supported from the support base and has finger depressions for receiving the digits and thumb of the skier's hand. The hand grip has an axis supported substantially orthogonal to the ski pole shaft. The support base preferably comprises a first section in line with a ski pole shaft and a second section interconnecting the first section and the hand grip and disposed at an angle to the first section so as to dispose the force center of the hand grip in line with the first section of the device. There is also provided an extension from the palm section of the ski pole grip projecting laterally over the proximal portion of the hand providing lateral support to the medial portion of the hand further providing retention of the entire grip to the hand.

15 Claims, 4 Drawing Figures

28
23
16
22
31
22A
11
10

28
L3
21A
23
20A
21
L1
20
19
27
19A
18A
18
22
22A
29
16
B
15
13
L2
A
12
14
L4
11
10

28
23
16
24
25
26
31
14
11
10

21
24
16
20
25
19
26
18
28
23
27
30
31

SKI POLE HAND GRIP

BACKGROUND OF THE INVENTION

The present invention relates in general to a ski pole hand grip. More particularly, the present invention relates to a ski pole hand grip that enables the hand to automatically engage the grip and ski pole in a more natural position and thus more optimally permit proper functional orientation of the hand, forearm and arm.

Ski poles have traditionally been made with a vertical shaft that supports at its top end a ski pole grip. The ski pole grip is on the same axis as the ski pole shaft thus resulting in the positioning of a hand so that the thumb faces superiorly and medially. Furthermore, the medial portion of the hand on the fifth digit side thereof is directed inferiorly or downward towards the earth's surface. This results in the palms facing medially or towards each other when the ski poles are held in their natural vertical position with the arms extended in front of the individual. Thus, the hand is held in a vertical or near vertical position so that if an imaginary line were drawn through the second, third, forth and fifth digits it would be parallel to the ski pole shaft and perpendicular or near perpendicular to the earth's surface.

With regard to prior art patents known to the applicant, U.S. Pat. Nos. 3,880,443 and 3,992,021 both to Tobin clearly illustrate the vertically disposed hand grip. U.S. Pat. No. 3,933,364 to With shows an angled or curved ski pole shaft. However, in the With patent it is noted that there is not any significant change in the hand grip from the vertical axis. The axis as illustrated in the With patent is still vertical. U.S. Pat. No. 3,085,814 to Scott and U.S. Pat. No. 3,436,090 to Lange et al. also illustrate a slight angulation of the shaft adjacent to the grip connection to the shaft. However, again, the hand grip is vertical. U.S. Pat. No. 3,582,100 to Allsop also illustrates an angulation at the top of the ski pole shaft. None of the above patents illustrate a resulting hand position that is very different from that of the traditionally-held vertical axis position.

One of the chief disadvantages with all previous ski poles and grips is that the hand and arm must function in a much more limited scope and weaker functional position. When the hand engages a traditional grip, the palm of the hand faces horizontally or in a direction parallel to the earth's surface. Stated in another way, if a plane were placed upon the palm, this plane would be perpendicular to the earth's surface. With the hand thus engaged in the traditional ski pole grip, when a person is in the process of skiing and plants the ski pole forward in anticipation of the next turn, the wrist joint flexes upward. Medically speaking the lateral border of the hand abducts or flexes upward and towards the individual. The inherent problem with this hand position is that the natural range of motion of the wrist from abduction to adduction is limited. The forearm muscles that control these actions are also weaker. The thumb position in the traditional grip is also compromised in terms of strength, stability and function. One of the most frequent ski accidents presently involves a fracture or spraining injury to the thumb. The popular term, "skier's thumb" has arisen from this common problem. The possible reason for this is that when the ski pole is planted forward in anticipation of the next turn, if the skier is skiing with any speed, or the snow surface is particularly hard, the pole hits the snow with considerable impact. This abrupt force is transmitted to the shaft of the ski pole, then to the ski pole grip and finally to the hand. With the thumb and opposing fingers or digits tightly grasping the grip, the thumb is torqued in an injury provoking manner. If this occurs with sufficient impact or with sufficient frequency, the skier begins to notice discomfort or frank pain in the proximal portion of the thumb.

With the traditional ski pole grip with the hand positioned on the vertical axis, when the skier attempts to propel himself along a flat or uphill surface as occurs in downhill skiing or also in cross country skiing, he must pull and then push off the pole. As mentioned previously, because of the traditional hand placement, the forearm musculature is in a functionally disadvantaged position. Again, the range of motion of the wrist joint in this position, is more limited.

The above historical description and review outlines the disadvantages of traditional ski pole hand grips.

SUMMARY OF THE INVENTION

The proposed invention is an attempt to rectify the inherent disadvantages of the traditional ski pole grip orientation relative to the hand. THe proposed grip is oriented such that when the hand fully engages the grip, the palm or ventral surface of the hand faces downward towards the earth's surface. The plane of the ventral surface of the hand is parallel or near parallel to the plane of the earth's surface. The second through fifth digits extend forward and then downward thus wrapping around the molded body of the grip resulting in the placement of the very distal ends of the digits on the inferior surface of the grip and thus opposing the palm or ventral surface of the hand. The thumb has its own molded section of the grip locating the thumb medially and inferiorly wrapping around the extension flange from the main body of the grip, resulting in its placement opposing the second digit, but not touching any of the four remaining digits. There is a lateral extension flange from the main body of the grip which extends over the dorsal surface of the hand just proximal to the metacarpal joints stopping over the second digit. This flat extension has inherent flexibility such that it retains the grip to the hand, but allows immediate disengagement. With the horizontal positioning of the hand when engaged with the ski pole grip, this allows a drastically increased range of motion at the wrist joint. In this newly proposed position, the wrist can fully extend and flex two to three times the maximum range of motion when flexing and extending as opposed to the vertically positioned hand. With the hand in this horizontal position, the wrist is also oriented such that it can function with significantly greater strength because of the improved positioning of the hand, wrist, forearm and arm musculature. In this more natural position, the hand and arm are more capable of absorbing impact from the process of pole planting in the act of skiing downhill or cross country. With the medially and inferiorly positioned thumb, there is a very significant lessening or elimination of impact induced torsional strain and thus results in fewer injuries to the thumb. With this invention's proposed hand placement, poling along horizontal or uphill surfaces is also more efficient and stronger.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

FIGS. 1–4 illustrate a preferred embodiment of the ski pole hand grip of the present invention. It is noted that in accordance with the invention, the hand gripping surface is disposed horizontal or substantially horizontal, which is totally opposite to the common type of vertical arrangement of hand grip.

Figure 1:
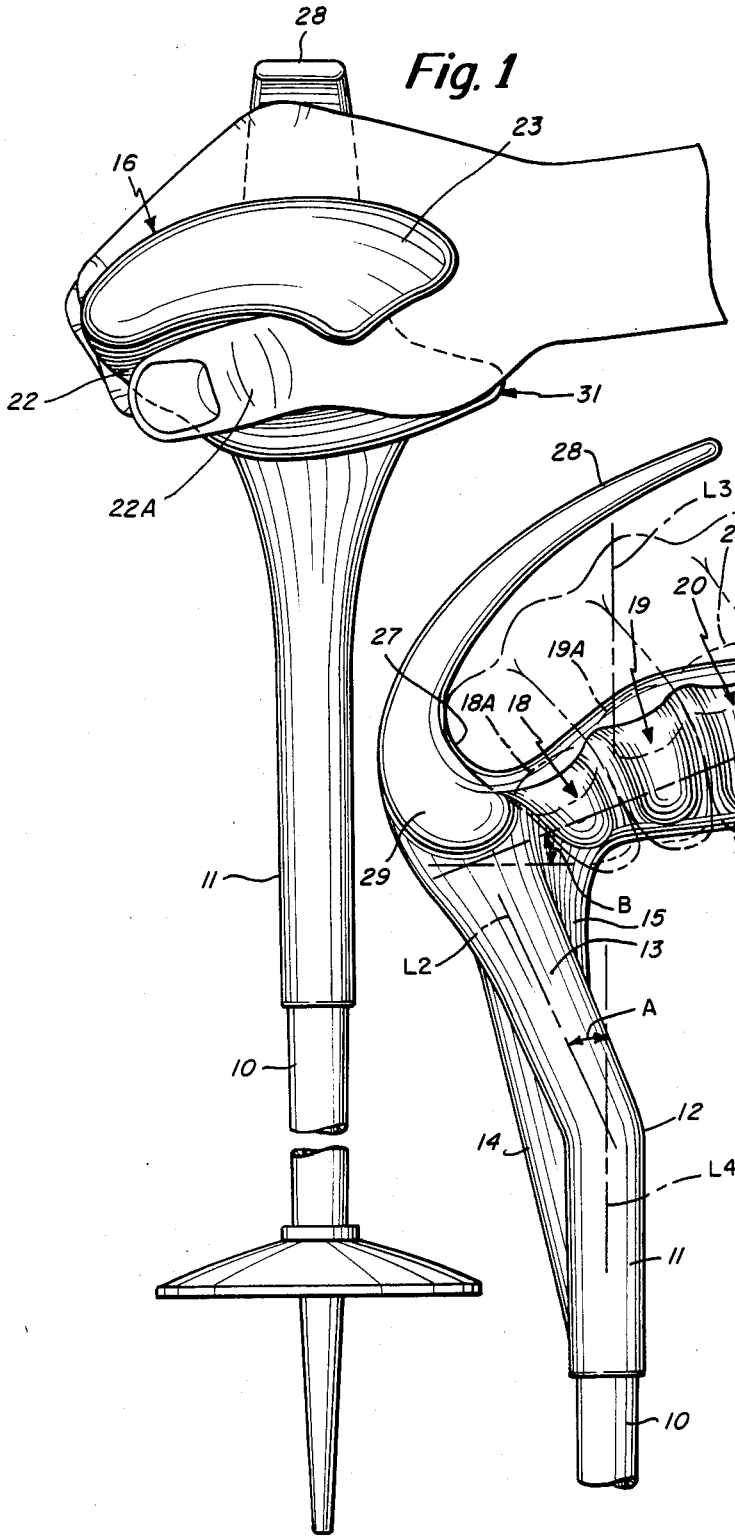
FIG. 1 is a side elevation view of a ski pole hand grip constructed in accordance with the principles of the present invention.

In the preferred embodiment that is described, there is illustrated, a ski pole that is of generally cylindrical shape and that may have a standard type of configuration at the bottom thereof such as illustrated in FIGS. 1. It is to be understood that the hand grip of the present invention may be adapted for use with any type of ski pole and ski pole shaft construction.

Thus, as illustrated in the drawings herein, there is provided a ski pole shaft 10 which is of generally cylindrical construction and which may be made of various types of materials such as metal, or petrochemical derivatives or composites. The ski pole shaft 10 receives the hand grip of the present invention. This hand grip includes a vertical section 11. It is the vertical section 11 that engages and attaches the hand grip to the ski pole shaft 10. The vertical section 11 is cylindrical and is internally at least partially hollow so as to receive the ski pole shaft. This section is vertical and perpendicular to the earth's surface.

The vertical section 11 ends at the bend 12 where the structure turns into a secondary cylindrical section 13, as clearly illustrated in FIG. 2 that angles away from the vertical at a preferred range of angles to be described hereinafter. These two cylindrical sections 11 and 13 are reinforced by a laterally placed reinforcing ridge 14 that strengthens the member at the bend 12. Similarly, there is also provided a similar reinforcing ridge 15 that is adapted to reinforce and strengthen the angulation created by the angled relationship between section 13 and the hand grip generally illustrated at 16.

Figure 2:
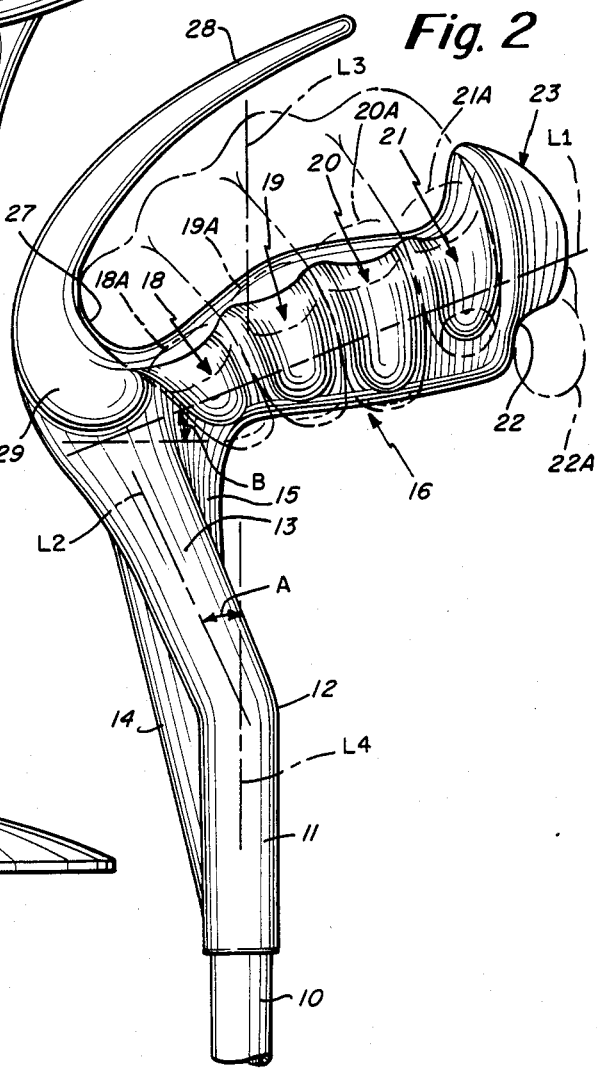
FIG. 2 is a front elevation view of the same ski pole hand grip.

With further reference to FIG. 2, it is noted that there is defined an angle A which is representative of the angle that the section 13 is away from the vertical as represented by the section 11. FIG. 2 also illustrates another angle referred to in FIG. 2 as angle B which is illustrative of a preferred range of angles that the hand grip is disposed relative to the horizontal, but preferably close to a horizontal position. There may also be taught as of a third angle falling between the lines L1 and L2 which is an angle between section 13 and the hand grip 16. This is an angle formed between section 13 and the hand grip 16 and this requires significant support by means of the support ridge 15.

On the hand grip 16, there are a plurality of imprint depressions to receive the fingers of the hand. In this regard, there is provided an imprint depression 18 to receive the fifth digit of the hand, an imprint depression 19 to receive the fourth digit, an imprint depression 20 to receive the third digit, and an imprint depression 21 to receive the second digit. Finally, at the hand grip 16 there is an imprint depression 22 that is adapted to accept the thumb. In this regard, note FIG. 1 and the placement of the thumb 22A in this imprint depression 22. Also note in FIG. 1 the overall hand position with the hand interlocked with the four digits in the finger depressions and the thumb in the thumb imprint depression.

Within the thumb depression 22, there is a medial flange 23 that delineates the most medial portion of the grip and which provides support to the entire second digit including the entire thumb to allow these two digits to oppose each other. In this regard, refer to FIG. 2 which shows the placement of the second digit 21A opposed to the thumb 22A on essentially either side of the medial flange 23.

Figure 4:
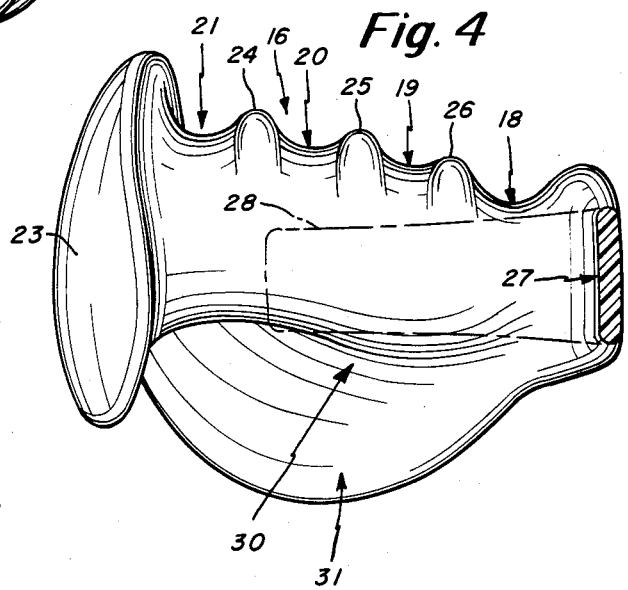
FIG. 4 is a top plan view of the ski pole hand grip illustrated in FIGS. 1–3.

As illustrated in FIG. 4, the imprint depressions are formed with elevated ridges therebetween such as the ridges 24, 25, and 26 illustrated in FIG. 4. These ridges separate the second and third digits, the third and fourth digits and the fourth and fifth digits, respectively.

The most lateral border of the hand grip is at 27. This provides support to the medial border of the hand. From the border 27, the hand grip extends in a flexible band 28 which extends over the knuckles of the second through fifth digits as clearly illustrated in FIG. 2. Thus, this enclosing band 28 forms a retaining extension from the grip which superiorly covers the fifth, fourth, third, and second proximal portions of the digits just proximal to the respective metacarpal joints. At the base 29 of the band or extension, the member is relatively rigid and becomes more flexible as the band becomes narrower toward the free end thereof. It is important that the band 28 have a sufficient amount of flexibility as this allows the entire hand to be quickly disengaged from the ski pole grip through the opening that is present between the medial flange 23 and the band or extension 28. Also, because of the retaining extensions flexibility, this allows even more simplified disengagement.

As part of the hand grip there is also provided a section 30 that represents an elevated portion which supports the ventral surface and central depression area of the palm of the hand. Related to this is also the horizontal palm support flange 31 which supports the entire ventral surface of the palm as far as the wrist joint at the crease of the hand.

In connection with the drawings, FIG. 1 represents a view of the medial left side of the right hand ski pole grip. This view clearly illustrates the medial flange 23 and its associated thumb imprint depression 22. FIG. 1 also shows the horizontal palm support flange 31 which supports the entire ventral surface of the palm. FIG. 1 also shows the flexible retaining extension 28.

Figure 3:
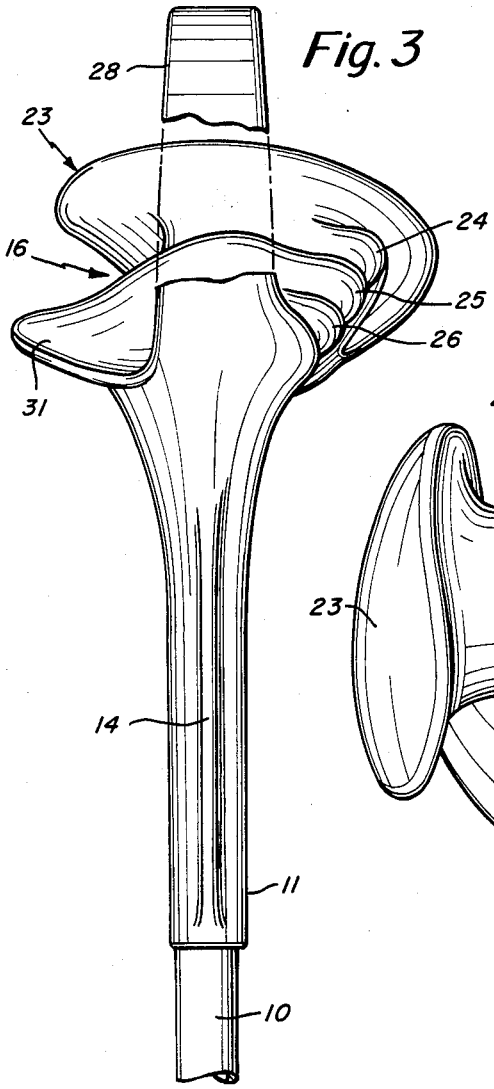
FIG. 3 is an opposite side elevation view of the ski pole hand grip of the invention.

Again, in accordance with the principle of the present invention, it is preferred to provide the axis of the hand grip 16 at either a horizontal position or preferably at a position slightly angled from the horizontal as illustrated by the angle B in FIG. 2. This angle may be in the range of 0°–45°, but is preferably in the range of 0°–30° to the horizontal. In this regard it is also noted that the near horizontal palm support flange 31 such as illustrated in FIG. 3 is lower than the lateral when the hand completely engages the grip.

Reference has also been made hereinbefore to the angle A in FIG. 2. The preferred range of the angle A is on the order of 0°–30°. It is moreover desired that the hand grip 16 be placed in a manner wherein the force center of the hand is represented by the line L3 in FIG. 2 is substantially in line with the axis L4 of the section 11 and of course, also in line with the axis of the ski pole shaft. In this way, the vertical shaft axis is congruent with the center of effort placed on the ski pole grip which would be near to the center of the palm. In this regard, note in FIG. 2 that the lines L3 and L4 for the most part are in line indicating this relationship. This provides for direct and immediate force transmission from the hand to the ski pole shaft.

In the drawings and in particular in FIG. 2, it is noted that the angular relationship of the hand grip to the ski pole shaft is illustrated as being fixed. Alternatively, there may be a variable angulation provided. This allows the individual skier to adjust the degree of angulation of the angle B to determine the most comfortable and functional angular relationship. This angular adjustment may be provided by a standard interlocking pivot structure.

The ski pole hand grip of the present invention may be constructed of many different types of materials, but preferably is constructed for the most part of a hard durable plastic material. The only portion of the grip that is not of a rigid material is the flexible extension 28. In manufacturing the hand grip, the main part of the hand grip along with the base of the extension may be made of a rigid plastic material and then in a second step, a more flexible material may be added to the hand grip forming the extension 28. The flexibility at the extension 28 is desired so as to enable easy disengagement of the hand from the ski pole so as to prevent accidents.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A ski pole hand support member attached to a ski pole shaft and comprising;

a support base adapted to be attached to the top of the ski pole shaft, said support base comprising a first section for connection to the ski pole and an integral second section, and a hand grip integrally supported from the support base second section and having a force center and means for receiving the skier's hand, said support base second section being disposed at an angle A to the ski pole shaft axis, said angle A being in a medial-lateral plane of the skier, the angular displacement of the support base second section disposing the top thereof in a position displaced on one side of the ski pole shaft axis, said hand grip being supported from the support base second section from one end of the hand grip with the other end of the hand grip free and terminating on the other side of the ski pole shaft axis, said hand grip being disposed at an angle B to the normal to the ski pole shaft axis, said angle B being in a medial-lateral plane of the skier, the angular displacement of the support base second section and hand grip disposing the force center of the hand grip in line with the ski pole shaft axis.

2. A ski pole hand grip as set forth in claim 1 wherein said first section is in line with the ski pole shaft.

3. A ski pole hand grip as set forth in claim 2 wherein said first and second sections are joined at a bend and are further supported by a reinforcing member therebetween.

4. A ski pole hand grip as set forth in claim 3 wherein said first and second sections are both cylindrical.

5. A ski pole hand grip as set forth in claim 4 including a flexible extension disposed to cover the hand and extending from the hand grip.

6. A ski pole hand grip as set forth in claim 5 wherein the angle A between the first and second sections is on the order of 0°–30°.

7. A ski pole hand grip as set forth in claim 1 wherein the support base second section attaches to only one end of the hand grip.

8. A ski pole hand grip as set forth in claim 7 including a flexible extension disposed over the hand and extending from the hand grip at the same end that the hand grip is supported from the support base.

9. A ski pole hand grip as set forth in claim 1 wherein the hand grip is generally cylindrical so as to enable the fingers to be wrapped thereabout.

10. A ski pole hand grip as set forth in claim 9 wherein the axis of the hand grip is supported at an angle B to the normal to the ski pole shaft axis on the order of 0°–45°.

11. A ski pole hand grip as set forth in claim 10 wherein the hand grip axis angle is on the order of 0°–30°.

12. A ski pole hand grip as set forth in claim 1 wherein the hand grip has multiple depressions for receiving the second through fifth digits and also a thumb depression.

13. A ski pole hand grip as set forth in claim 12 including a medial flange at least in part defining the thumb depression and providing support between the thumb and second digit to enable the thumb and second digit to be in opposed position.

14. A ski pole hand grip as set forth in claim 13 including an elevation adjacent the medial flange for fitting with the palm depression.

15. A ski pole hand grip as set forth in claim 13 wherein the thumb depression is disposed in the very free end of the hand grip and under the medial flange.

* * * * *